US008360672B2

(12) United States Patent
Stubbs

(10) Patent No.: US 8,360,672 B2
(45) Date of Patent: Jan. 29, 2013

(54) POWER TROWEL AND METHOD FOR APPLYING FINISH COMPOUNDS

(75) Inventor: William Troy Stubbs, Hurricane, UT (US)

(73) Assignees: William Troy Stubbs, Hurricane, UT (US); Bruce Whited, New Harmony, UT (US)

( * ) Notice: Subject to any disclaimer, the term of this patent is extended or adjusted under 35 U.S.C. 154(b) by 1339 days.

(21) Appl. No.: 11/897,023

(22) Filed: Aug. 28, 2007

(65) Prior Publication Data

US 2009/0060627 A1 Mar. 5, 2009

(51) Int. Cl.
*B05C 11/00* (2006.01)

(52) U.S. Cl. ..... 401/266; 401/265

(58) Field of Classification Search ..... 401/266, 401/263, 265; 239/302, 337, 349, 357, 378, 239/525, 526, 532, 753, 754
See application file for complete search history.

(56) References Cited

U.S. PATENT DOCUMENTS

| | | | | |
|---|---|---|---|---|
| 1,507,807 | A | 3/1923 | Beeson | |
| 2,411,317 | A | 7/1944 | Day et al. | |
| 2,666,323 | A | 9/1951 | Ames | |
| 3,162,328 | A | 2/1961 | Frume | |
| 3,104,410 | A | 1/1962 | Ames | |
| 3,451,757 | A | 11/1967 | Stroud et al. | |
| 4,009,666 | A * | 3/1977 | Russell et al. | 111/127 |
| 4,048,471 | A | 9/1977 | Ours | |
| 5,277,511 | A | 1/1994 | Stockton | |
| 5,362,165 | A | 11/1994 | Kluga et al. | |
| 5,381,962 | A * | 1/1995 | Teague | 239/526 |
| 5,593,091 | A * | 1/1997 | Harris | 239/127 |
| 5,681,125 | A | 10/1997 | Amaya | |
| 5,759,343 | A | 6/1998 | Roberts | |
| 5,797,692 | A | 8/1998 | Poole et al. | |
| 5,878,921 | A | 3/1999 | Chase et al. | |
| 5,882,691 | A | 3/1999 | Conboy | |
| 5,902,451 | A | 5/1999 | O'Mara et al. | |
| 6,120,203 | A | 9/2000 | Modders | |
| 6,132,134 | A | 10/2000 | Hodgson | |
| 6,196,742 | B1 | 3/2001 | Tarver, III | |
| 6,450,723 | B1 | 9/2002 | Lithgow | |
| 6,668,897 | B2 | 12/2003 | Gunn | |
| 6,698,961 | B2 | 3/2004 | Pollock | |
| 6,739,798 | B2 | 5/2004 | Vandewinckel et al. | |
| 6,877,923 | B2 | 4/2005 | Grayden | |
| 2003/0111487 | A1 | 6/2003 | Peeler et al. | |
| 2005/0274747 | A1 | 12/2005 | Dee et al. | |
| 2006/0037171 | A1 | 2/2006 | Guest et al. | |

* cited by examiner

*Primary Examiner* — Davis Hwu
(74) *Attorney, Agent, or Firm* — Clayton, Howarth & Cannon, P.C.

(57) ABSTRACT

A tool for applying finish compound to a structural member is disclosed. The tool includes a conduit, a handle and a finish-compound receiving member. The conduit may include a single discharge hose or may include a plurality of discharge hoses. The handle may include a first support and a second support acting as a grip for a user to grasp the tool. The handle may further include at least one hole formed in the handle to receive the conduit. The finish-compound receiving member may include a finish-compound receiving surface having at least one opening formed therein. The conduit leads from a pump that is in communication with a reservoir of finish compound to the at least one hole in the handle. The handle also includes a hollow interior, such that finish compound is pumped through the conduit into the hollow interior. The hollow interior communicates with the at least one opening formed in the finish-compound receiving surface for dispensing finish compound to the finish-compound receiving surface for application.

94 Claims, 7 Drawing Sheets

POWER TROWEL AND METHOD FOR APPLYING FINISH COMPOUNDS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

1. The Field of the Invention

The present disclosure relates generally to devices and systems for applying finish compounds, such as to walls and ceilings for example, and more particularly, but not necessarily entirely, to an application tool or device and method in which a finish compound is controllably pumped from a reserve supply through a flexible conduit to the application tool or device.

2. Description of Related Art

It is known in the construction industry generally, whether commercial or residential construction, to use finish compounds such as mortar, stucco, plaster, joint compounds or other finish materials in various projects, including, inter alia, driveways and walkways, foundations, brick and stone used on the exterior and interior of buildings or structures, tile and other flooring materials, and drywall. Such construction projects that use a finish compound material involve the controlled application of a semi-liquid or plastic-type material such as paste, adhesive, plaster, grout, drywall compound, and other materials to a structural member.

Through common usage, these various compositions are referred to in the construction trade as "mud" or "mortar," whether the worker is a bricklayer, stone mason, concrete finisher, plasterer, carpenter, drywall finisher, or the like. It will be appreciated that for ease of understanding, the term "finish compound" will be used herein as a generic reference to denote any suitable, semi-liquid material capable of being pumped through a conduit and that has the ability to bond, adhere or attach to a structural member or to unite two structural members together, whether or not the finish compound may also be known or referred to as "cementitious material" or "grout" or "mud." In other words, as used herein "finish compound" is a broad term referring to various types of materials, including cementitious materials, grouts or mud.

In any of the applications noted above, a construction worker customarily applies the finish compound to a structural member, such as an individual brick, stone, tile, stud, floor board, or other structural member by obtaining finish compound from a source (for example, a bucket or wheelbarrow) using a trowel or other device. Regardless of the particular type of finish compound or its mode of application, the construction worker must take valuable work time and energy to continually return to the bulk source of finish compound to refill the particular device used for carrying the finish compound during the application procedure.

For example, the most common method of application of finish compound is known as the "on-hand supply" method, which refers to the quantity of finish compound that can be carried, for example, on a mortar board held in a worker's non-working hand. Stone masons, bricklayers and drywall plasterers are examples of the types of workers that may utilize the on-hand supply method. It is from the on-hand supply that the worker replenishes the finish compound that is applied to a surface of a structural material using a trowel or other hand tool.

It will be appreciated that the average construction worker is limited in the amount of finish compound that can be carried and utilized effectively. For example, because construction workers utilizing finish compound often work on ladders or stilts, a maximum weight of about five to ten pounds of finish compound may be carried at any one time. Thus, frequent returns to the bulk supply of finish compound to replenish the on-hand supply is required. Accordingly, valuable time, effort and energy is lost by using the on-hand supply method of carrying and applying finish compound to a surface.

There are several reasons a construction worker's efficiency may be impeded using the on-hand supply method in the application of finish compound. Because of the nature of finish compound, only a limited quantity of finish compound can be carried by a construction worker. Finish compound such as plaster, stucco or grout must be applied in a semi-liquid state in order to function properly, thus to reduce excessive drying or setting of the on-hand supply of finish compound only a limited amount can be utilized at one time. Another impediment to a construction worker's efficiency includes the use of only one hand for operation of the trowel or hand tool as the other hand is required to carry or hold the mortar board, on which the on-hand supply of finish compound is carried. Finally, the construction worker's efficiency may be impeded simply by the amount of energy that is lost during the frequent returns to the bulk supply of finish compound and energy utilized carrying and holding five to ten pounds of finish compound. Thus, the on-hand supply method impedes the efficiency of the construction worker.

There is a long felt, but currently unmet need, for an automatic, portable delivery device for supplying finish compound to a receiving member and surface for use in construction projects that is inexpensive to make, simple in operation and that can be efficiently used by a construction worker. The devices and systems known to applicant are characterized by several disadvantages that may be addressed by the present disclosure. The present disclosure may minimize, and in some aspects may eliminate, the failures, and other problems of the known delivery devices and systems, by utilizing the methods and structural features described herein.

The features and advantages of the disclosure will be set forth in the description that follows, and in part will be apparent from the description, or may be learned by the practice of the disclosure without undue experimentation. The features and advantages of the disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
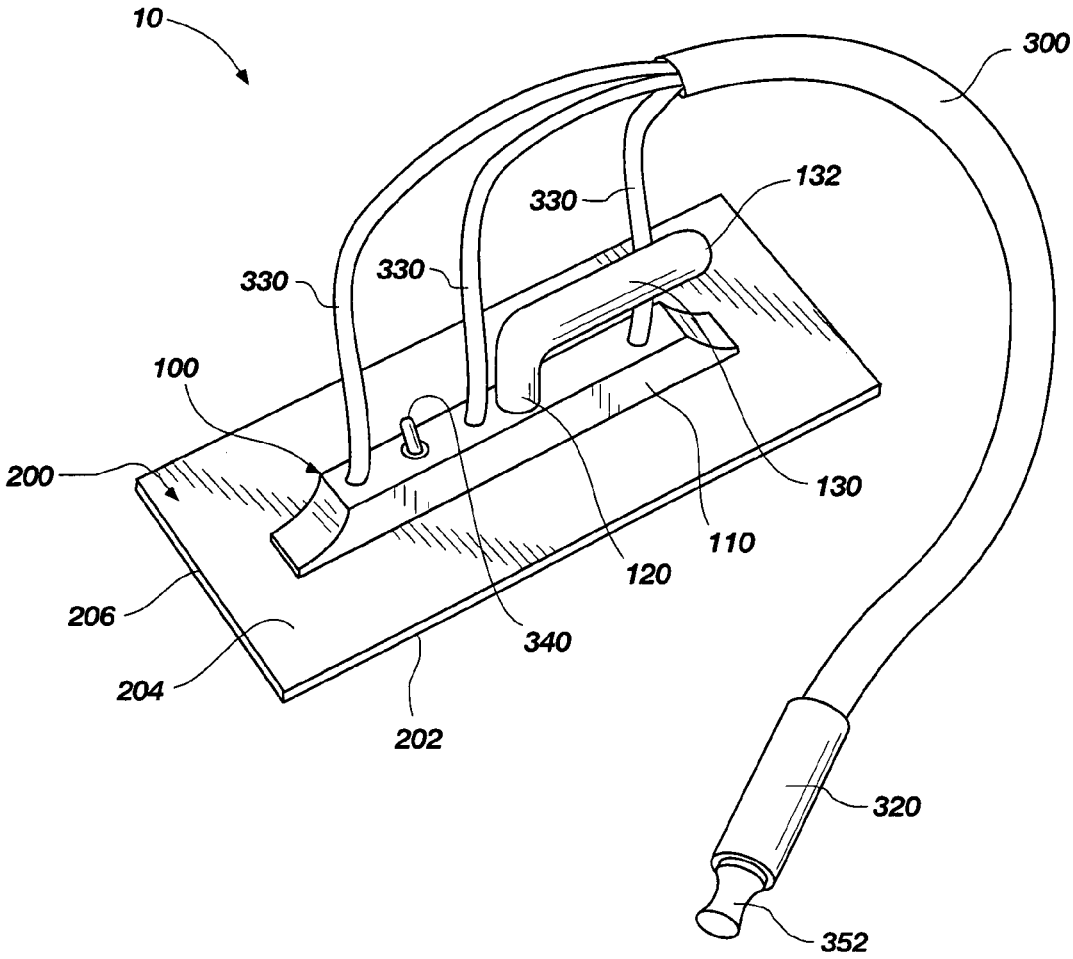
FIG. 1 is a schematic, perspective view of an embodiment of a device for applying finish compound made in accordance with the principles of the present disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, that would normally occur to one skilled in the relevant art and having possession of this disclosure, are to be considered within the scope of the disclosure claimed.

It is to be understood that this disclosure is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the present disclosure will be limited only by the appended claims and equivalents thereof.

In describing and claiming the present disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterized by," and grammatical equivalents thereof are inclusive or open-ended terms that do not exclude additional, unrecited elements or method steps.

As used herein, the phrase "consisting of" and grammatical equivalents thereof exclude any element, step, or ingredient not specified in the claim.

The present disclosure pertains to a device and method for applying finish compounds, such as plaster, stucco, drywall joint compound or other finish compounds, especially textured finish compounds. The device can be used to finish drywall joints, and more particularly, it applies to the work of plaster finishing entire ceilings or walls over a large surface area, such as an exterior stucco finish, for example. The device can be used to apply both a base coat and a finish coat thereafter, the finish coat being textured or otherwise.

It will be appreciated that in the construction industry, various materials may be considered as finish compound or cementitious material. It will be appreciated that as used herein, the term "finish compound" refers to any one of a variety of materials or compounds for bonding, adhering or attaching structural items or objects together or for bonding, adhering or attaching to a structural item or object, for example a joint compound as applied to drywall. For example, bonding materials commonly referred to as "grout," may or may not include an element of cement and as such may be grouped to a broader category of materials referred to and defined herein as "finish compound." When "grout" contains an element of cement it may fall into a broader category of materials known as "cementitious material." Materials that may be classified as grout or mud or cementitious material are for purposes of this disclosure referred to herein collectively as finish compound.

Specifically, and by way of background, grout used to fill cracks or holes in concrete, such as driveways or walkways, may consist of a mixture of cement, sand or aggregate, and water and is thus considered as finish compound and as cementitious material. In a plaster application, a grout mixture may consist of cement, fibers, fine sand, water, and coloring material and is thus considered as finish compound and as cementitious material. A grout material used in an application for bonding bricks or stone to a structure may include a mixture consisting of cement, sand, and water and is thus considered as finish compound and as cementitious material.

A grout material used for drywall purposes may comprise a mixture of very fine, plastic-like material with little or no shrinkage upon drying for use in patching holes in the drywall or to cover joints in the drywall surface and as such is considered a finish compound, even though it does not necessarily comprise any element of cement. Drywall grout may also bond to tape used to cover joints and corners where two pieces of drywall meet to provide a smooth, continuous wall surface. In carpentry, many processes require application of a bead of an adhesive material laid along several studs, rafters or other longitudinal members prior to mounting a sheet of plywood, plaster board, or other structural member, thereto and as such may be considered as finish compound.

Figure 2:
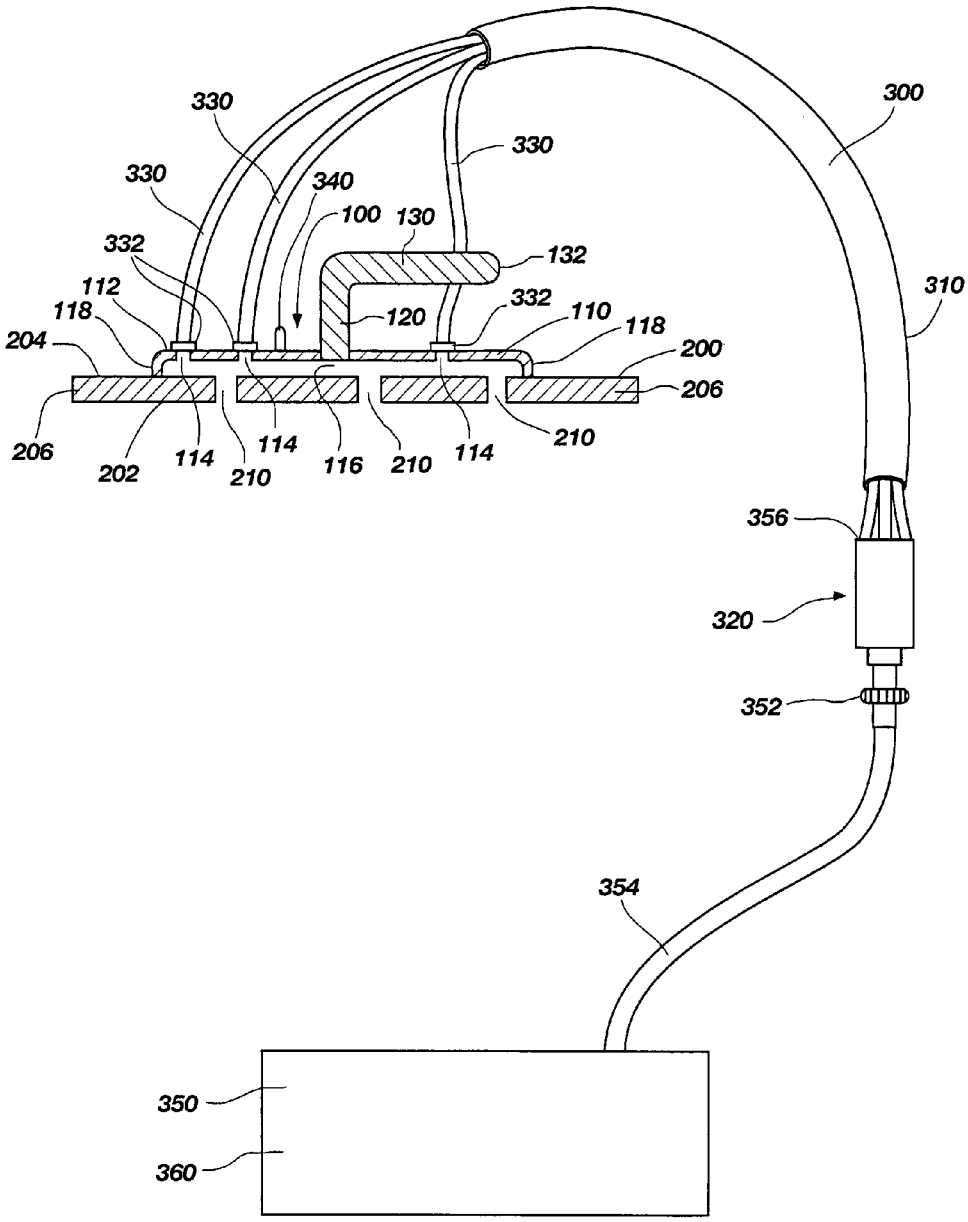
FIG. 2 is a side, partial cross-sectional view of an embodiment of a device for applying finish compound made in accordance with the principles of the present disclosure.

Referring now to FIGS. 1 and 2, the present disclosure is directed to a tool 10, such as a power trowel, for applying finish compound to a structural member. The tool 10 may comprise a handle 100, a finish-compound receiving member 200 having a finish-compound receiving surface 202, a conduit 300 and a pump 350. It will be appreciated that the pump 350 may be attached to or contain or may be in communication with a reservoir 360 of finish compound. The pump 350 may be any pump known, or that may become known, in the art in the future, without departing from the spirit or scope of the present disclosure.

The handle 100 may comprise a base 110 (sometimes referred to herein as a handle base). The handle base 110 may be elongated in a lateral direction and that may be attached to the finish-compound receiving member 200, and specifically to an upper or top surface 204 of the finish-compound receiving member 200, so as to extend therefrom. The handle base 110 may also be a receptacle for receiving finish compound, where the receptacle may contact the upper surface 204 of the finish-compound receiving member 200. The handle base or the receptacle 110 may comprise an area that is about three percent to about ninety-five percent of an area of the upper surface 204 of the finish-compound receiving member 200. More specifically, the area of the handle base or receptacle 110 may be about five percent to about fifty percent and even more specifically about five percent to about thirty-five percent of the area of the finish-compound receiving member 200.

The handle 100 may further comprise a first support 120 that may extend upwardly with respect to an upper or top surface 112 of the handle base 110 (illustrated best in FIG. 2) and a second support 130 that may extend laterally from the first support 120 and that may terminate in a free end 132. It will be appreciated that the second support 130 may also be a grip 130 and may be utilized by a user to grasp the handle 100 and the tool 10. It is further to be understood that the first support 120 and the second support 130 are optional.

Figure 7:
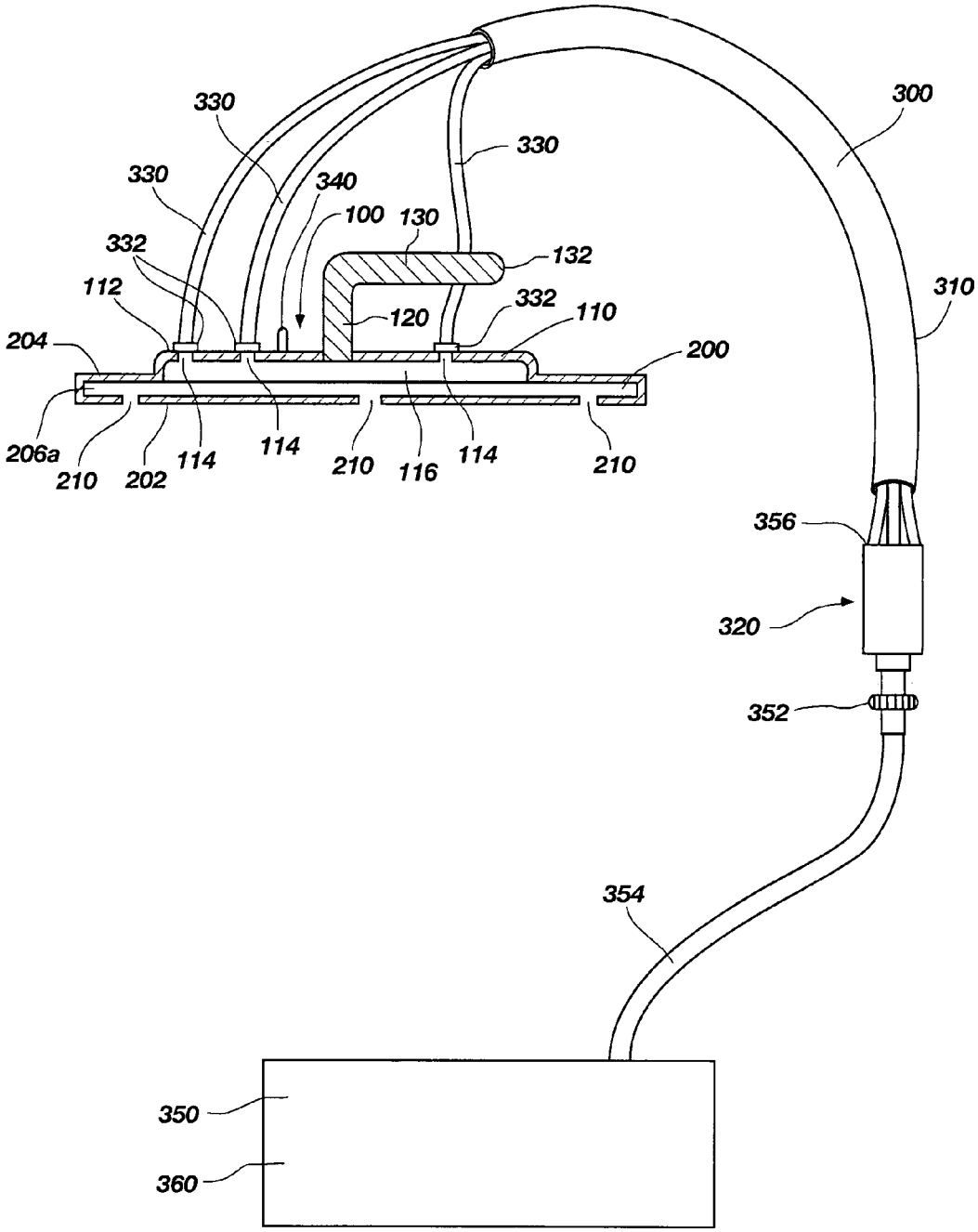
FIG. 7 is a side, partial cross-sectional view of another embodiment of a device for applying finish compound made in accordance with the principles of the present disclosure.
Figure 9:
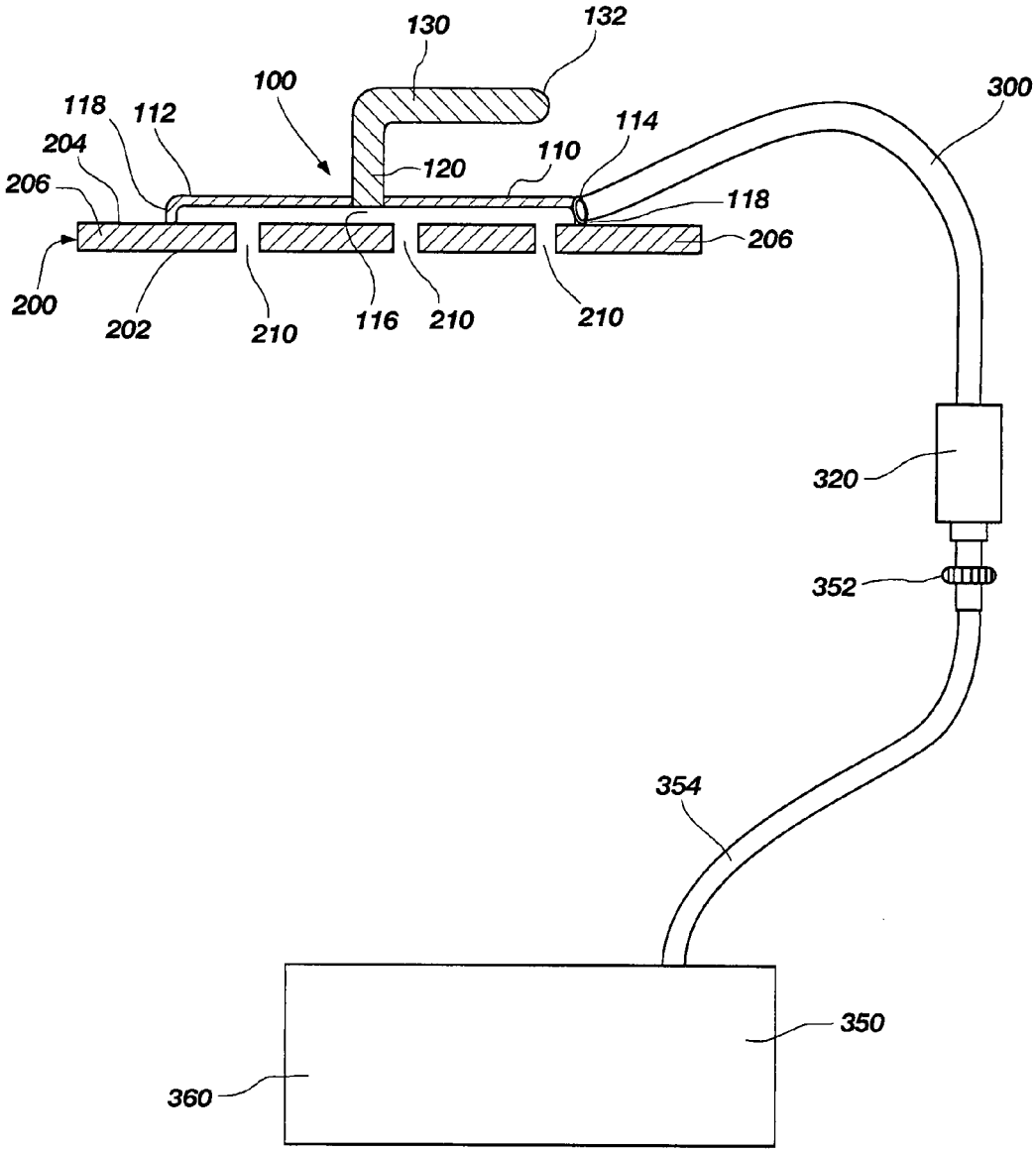
FIG. 9 is a side, partial cross-sectional view of another embodiment of a device for applying finish compound made in accordance with the principles of the present disclosure.

In the embodiments illustrated for example in FIGS. 2, 7 and 9, the first support 120 and the second support 130 of the handle 100 may both be substantially non-hollow. In such embodiments, the conduit 300 may be received in at least one hole 114 formed in the handle base 110 of the handle 100.

Figure 8:
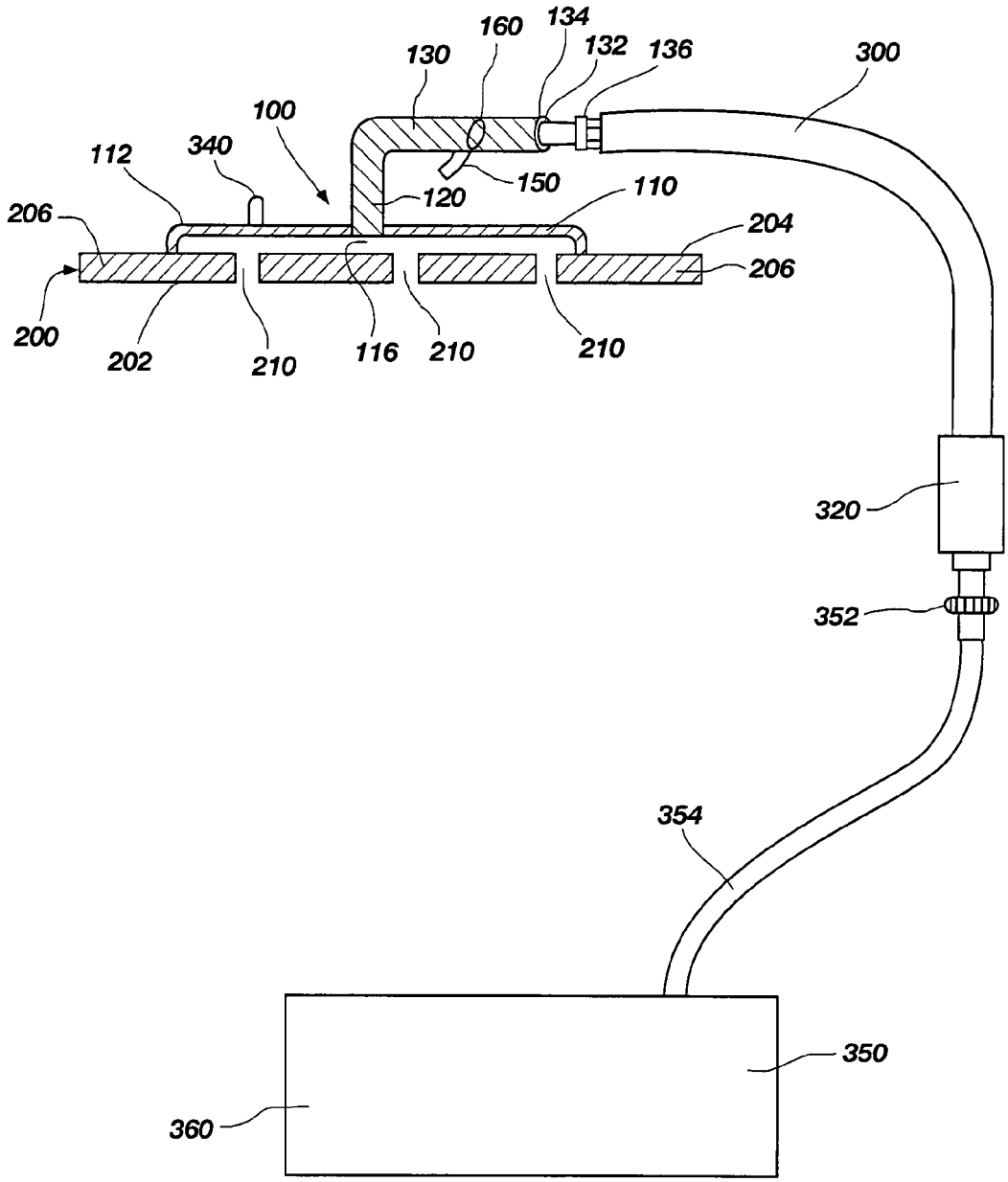
FIG. 8 is a side, partial cross-sectional view of another embodiment of a device for applying finish compound made in accordance with the principles of the present disclosure.

In another embodiment illustrated in FIG. 8, the first support 120 and the second support 130 of the handle 100 may both be substantially hollow. In such an embodiment, the conduit 300 may be attached to a coupler 136, which may be any known coupler, located at the free end 132 of the second support 130. Thus, finish compound may enter directly into an opening 134 formed in the free end 132 of the second support 130 and attached to the coupler 136, thereby pumping or otherwise dispensing finish compound directly into the second support 130 or grip of the handle 100.

It will be appreciated that in any of the embodiments discussed above (i.e., FIGS. 2, 7, 8 and 9), the second support or grip 130 may laterally extend from the first support 120, meaning that the second support 130 may be substantially parallel to the upper or top surface 112 of the handle base 110 and also to the top or upper surface 204 of the finish-compound receiving member 200. Alternatively, the second support 130 may include a component of vertical direction as it extends laterally from the first support 120. In other words, the second support 130 does not have to be substantially parallel with the handle base 110 or finish-compound receiving member 200 as described above, but may instead form an angle with the top or upper surface 112 of the handle base 110 or the top or upper surface 204 of the finish-compound receiving member 200.

As illustrated in FIGS. 2, 7 and 9, the handle base 110 of the handle 100 may include at least one hole 114 and may include a plurality of holes 114 formed through the top surface 112 (see FIGS. 2 and 7) or, alternatively, on a side surface 118 (see FIG. 9) of the handle base 110. It will be appreciated that the at least one hole 114 or plurality of holes 114 may operate to be disposed in fluidic communication with the conduit 300, thereby communicating with the conduit 300 and conveying finish compound to the handle 100.

It will be appreciated that the at least one hole 114 may be sized and shaped in any manner without departing from the spirit or scope of the present disclosure. However, the at least one hole 114 may include a diameter that may be substantially the same as a diameter of the conduit 300 to facilitate attachment. As illustrated in FIGS. 1 and 2, the at least one hole 114 in the handle 100 may include three holes 114 or may include a plurality of holes 114 without departing from the spirit or scope of the present disclosure.

Additionally, the at least one hole 114 or plurality of holes 114 may lead to and communicate directly with a hollow interior 116 of the handle 100. The hollow interior 116 may be used to accumulate, distribute and dispense the finish compound from the handle 100 to the finish-compound receiving surface 202. The hollow interior 116 may be formed inside of the handle base 110 of the handle 100. In other words, the handle base 110 of the handle may include the hollow interior 116, and the hollow interior 116 may not necessarily be part of the first support 120 or the second support or grip 130, although in an alternative embodiment the first support 120 and the second support 130 may be hollow (see FIG. 8).

It will be appreciated that the conduit 300 may be flexible and may be manufactured from any flexible material, although the flexibility of the conduit is not an imperative, and may be a hose or other duct for conveying the finish compound from the reservoir 360 to the handle 100. Depending upon the number of holes 114 formed in the handle 100, the conduit 300 may include an equal number of discharge hoses 330, whether a plurality or a single hose or duct, that may each be received in one hole 114 of the handle 100. It will be appreciated that the discharge hose or hoses 330 are disposed in fluidic communication with the at least one hole 114, for example by being received in the at least one hole 114 and attached to the handle 100 by way of a coupling device 332, such as a hose coupler. However, it is to be understood that the discharge hose or hoses 330 can be disposed in fluidic communication with said at least one hole 114 in any suitable manner.

For example, if the handle base 110 of the handle 100 includes a single hole 114, then only a single discharge hose 330, and accordingly a single coupling device 332, may be required. Alternatively, if the handle base 110 of the handle 100 includes a plurality of holes 114, then a matching number of discharge hoses 330, and a plurality of coupling devices 332, may be required. It will be appreciated that the coupling device 332 may or may not be necessary, and the coupling device 332 when utilized may be any known device for coupling a hose or duct to the handle 100.

The holes 114 may be aligned in a linear manner along with the top surface 112 or along the side surface 118 of the handle base 110, such that the discharge hoses 330 may also be aligned in a linear manner when connected to the handle 100. The linear alignment may help in distributing the finish compound equally or at a substantially constant flow rate into the handle 100, which may facilitate finish compound flow from the conduit 300 and discharge hoses 330 to the handle 100.

The conduit 300 may also include a central hose 310, which alternatively may be a sleeve 310, that may be attached to an attachment piece 320 at one end of the conduit 300, which may be opposite the discharge hose 330. It will be appreciated that the attachment piece 320 may itself be attached to or disposed in fluidic communication with the pump 350 or another hose or intermediate member for being attached to the pump 350.

Referring specifically to FIG. 2, there is illustrated three discharge hoses 330 that may be completely separate and individual and may be bound together by a sleeve 310 to avoid entanglement problems. Alternatively, FIG. 1 illustrates three discharge hoses 330 that may disseminate from the central hose 310. As used herein, the term "disseminate" may refer to a scenario where a plurality of parts separate or divide from a common object. In other words, the three discharge hoses 330 may merge or fuse together and combine into or otherwise be disposed in fluidic communication with the central hose 310, such that the discharge hoses 330 may disseminate from the conduit 300 or the central hose 310. In each embodiment, the three discharge hoses 330 may be attachable or otherwise disposable into fluidic communication with one of the holes 114 formed in the handle base 110 of the handle 100, at one end and the central hose 310, or the individual discharge hoses 330 may be attached to the attachment piece 320 at the opposite end.

The attachment piece 320 may be attachable to the pump 350, which may be in communication with the reservoir 360 of finish compound, and may comprise at least one hose coupling device or other coupling device 352 for coupling the conduit 300 to a second hose 354 or another part of the pump 350. On the opposite side of the coupling device 352, the attachment piece 320 may comprise a connector 356 that may operate to attach the conduit 300 itself, the central hose 310 or the discharge hoses 330 to the attachment piece 320, depending upon the embodiment. It will be appreciated that the attachment piece 320 may be a generic coupling device for attaching the conduit 300 to the pump 350 and device that operates or functions the same as the attachment piece 320 is intended to fall within the scope of the present disclosure.

The finish-compound receiving member 200 may be manufactured from a relatively hard, durable material to withstand the coarseness of the finish compound and application of the finish compound to the structural member. Thus, materials such as hard rubber, metal, or various other materials may be used without departing from the present disclosure. The finish-compound receiving member 200 may include the finish-compound receiving surface 202 or lower surface 202 that may be a substantially flat trowel surface and the top or upper surface 204 that may be formed opposite the finish-compound receiving surface 202.

It is to be understood that the finish compound may be pumped or otherwise dispensed directly into the handle 100, whether directly into the upper surface 112 or side surface 118 of the handle base 110 and into the hollow interior 116. Alternatively, the finish compound may also be pumped or otherwise dispensed directly into a hollow second support 130 and subsequently flowing from the second support 130 through a hollow first support 120 and into the hollow interior 116.

The finish-compound receiving member 200 may comprise a non-hollow body 206 (illustrated best in FIGS. 2, 8 and 9), which may provide benefits of durability for the finish-compound receiving member 200 and durability of the overall tool 10, in addition to cost effectiveness in manufacturing the finish-compound receiving member 200 and tool 10. Alternatively, the finish-compound receiving member 200 may comprise a substantially hollow body 206*a*, as illustrated in FIG. 7.

The finish-compound receiving surface 202 of any of the embodiments disclosed herein may have a length "L" that may be at least two times its width "W." The finish-compound receiving member 200 may be attachable to the handle 100 via any means known, or that may become known in the future, in the art. The finish-compound receiving member 200 may include at least one opening 210 formed therethrough, i.e., through the finish-compound receiving member 200, such that the at least one opening 210 opens at the finish-compound receiving surface 202, as illustrated best in FIGS. 2, 8 and 9.

The at least one opening 210 may be a plurality of openings 210 and may operate to dispense finish compound from the hollow interior 116 of the handle 100 to the finish-compound receiving surface 202. In other words, finish compound may be gradually dispensed from the hollow interior 116 of the handle 100 through the at least one opening 210 of the finish-compound receiving member 200 to the finish-compound receiving surface 202.

It will be appreciated that the at least one opening 210 may be sized and shaped in any manner without departing from the spirit or scope of the present disclosure. However, the at least one opening 210 may include a diameter within a range of about one percent to about ten percent of a length "L" of the finish-compound receiving member 200, and more particularly, about one percent to about three percent of a length of the finish-compound receiving member 200.

Referring now to FIGS. 3-6, it will be appreciated that the at least one opening 210 or plurality of openings 210 in the finish-compound receiving member 200 may aid in dispensing finish compound from the hollow interior 116 of the handle 100 to the finish-compound receiving surface 202. The plurality of openings 210 may be formed in a regular pattern.

Figure 3:
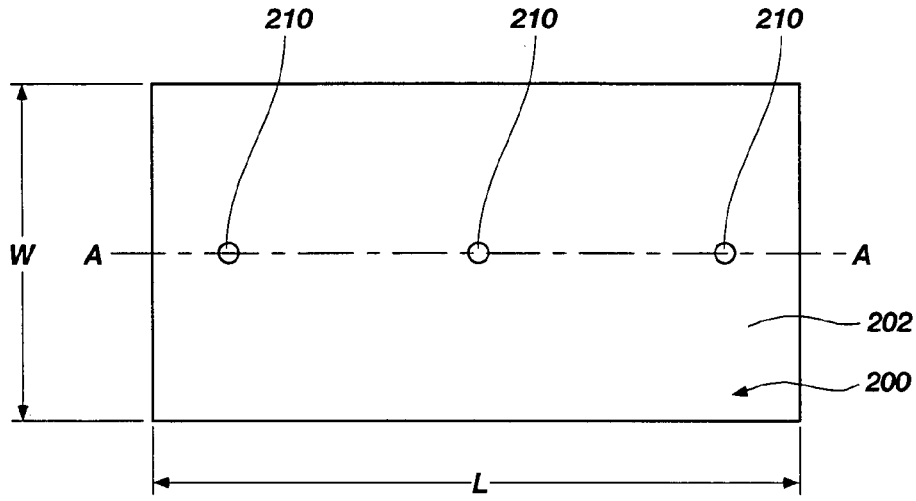
FIG. 3 is a bottom, schematic view of an embodiment of a finish-compound receiving member and surface made in accordance with the principles of the present disclosure.
Figure 6:
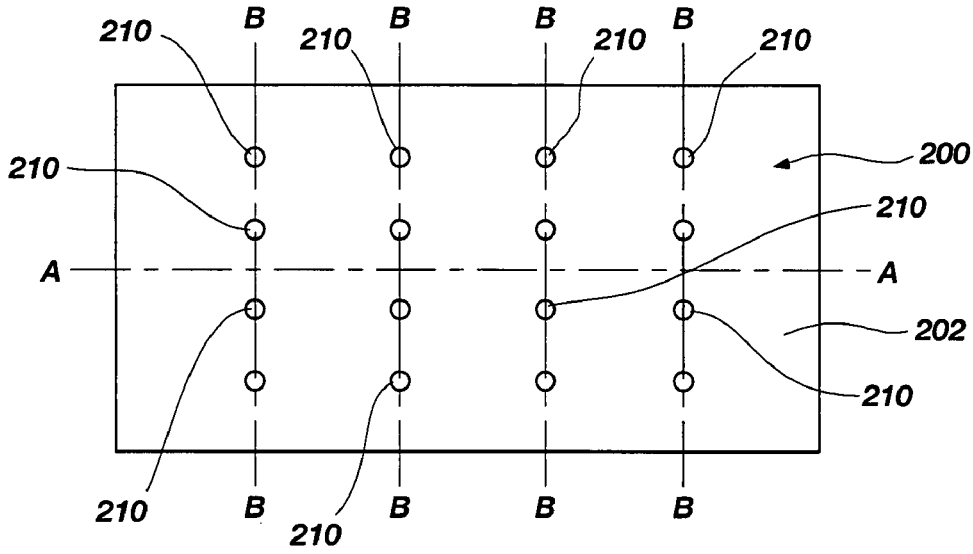
FIG. 6 is a bottom, schematic view of another embodiment of finish-compound receiving member and surface made in accordance with the principles of the present disclosure.

For example, as illustrated in FIGS. 3 and 6, the plurality of openings 210 may be substantially aligned in a linear manner or in a linear pattern. More specifically, the plurality of openings 210 may be linearly aligned along a central, longitudinal axis, represented by the line A-A or aligned along an axis that is parallel to the central, longitudinal axis A-A along. The plurality of openings 210 may also be aligned linearly along an axis, represented by the line B-B, that may be perpendicular to the central, longitudinal axis A-A, as illustrated in FIG. 6.

Figure 5:
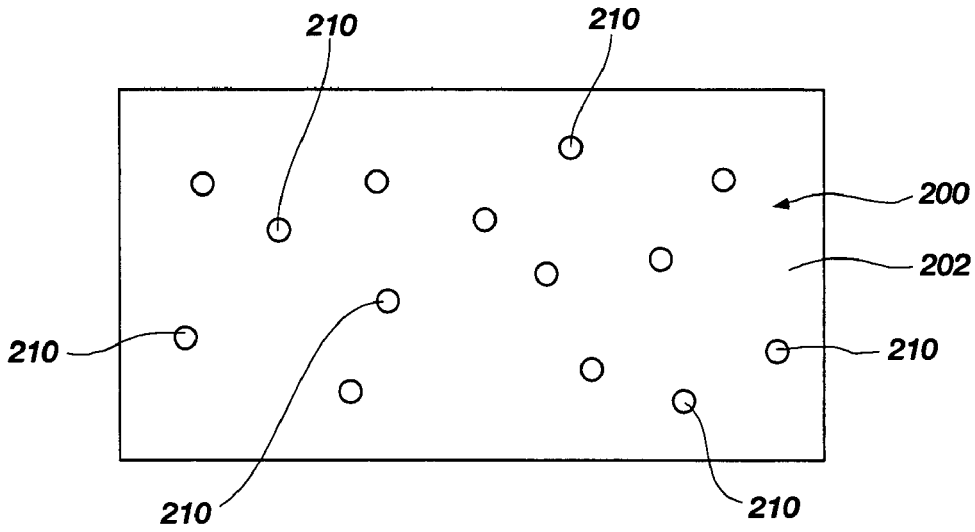
FIG. 5 is a bottom, schematic view of another embodiment of a finish-compound receiving member and surface made in accordance with the principles of the present disclosure.

Referring now to FIG. 5, it will be appreciated that the plurality of openings 210 do not necessarily have to be formed in a pattern within the finish-compound receiving surface 202. Instead, the plurality of openings 210 may be irregularly formed in the finish-compound receiving surface 202, so long as the finish compound may be dispersed or distributed to the finish-compound receiving surface 202.

Figure 4:
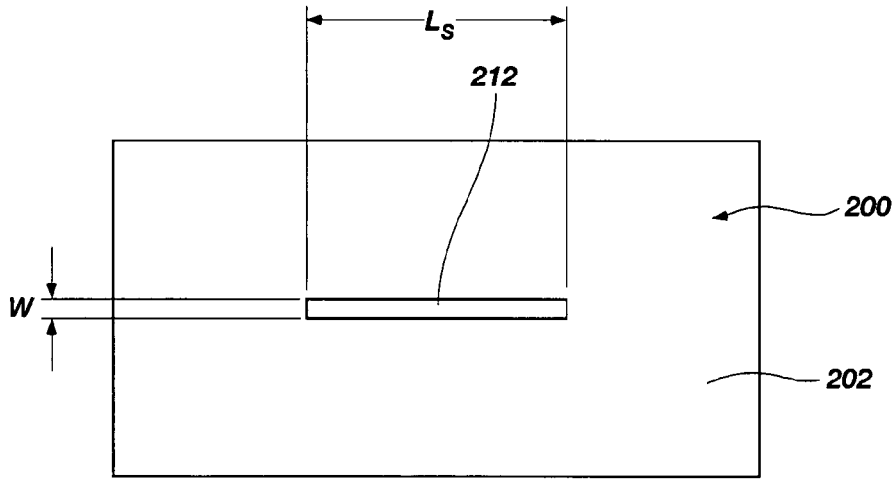
FIG. 4 is a bottom, schematic view of another embodiment of a finish-compound receiving member and surface made in accordance with the principles of the present disclosure.

It will be appreciated that the at least one opening 210 in the finish-compound receiving member 200, and thus opening at the finish-compound receiving surface 202, may be a single elongated slot 212, as illustrated in FIG. 4, for dispensing finish compound from the hollow interior 116 of the handle 100 to the finish-compound receiving surface 202. The elongated slot 212 may be longer than it is wide and may comprise a width "Ws" that may fall within a range of about one percent to about twenty percent of a length "Ls" of the slot 212. More specifically, the width "Ws" of the slot 212 may fall within a range of about five percent to about ten percent of the length "Ls" of the slot 212.

It will be appreciated that each embodiment of the finish-compound receiving member 200 may be removable from the device or tool 10 and replaced or interchanged with another finish-compound receiving member 200. Each of the finish-compound receiving members 200 may be attached to the device or tool 10 through means that are known in the art and any such attachment means falls within the scope of the present disclosure. Thus, any finish-compound receiving member 200 may be interchanged with another finish-compound receiving member 200 without departing from the scope of the present disclosure.

It is to be understood that finish-compound receiving members 200 having a plurality of small openings 210 may be used in conjunction with finish compounds that may have a relatively smooth texture and application, such as drywall mud. On the other hand, finish-compound receiving members 200 having larger openings or slots 210 may be used in conjunction with finish compounds that may be relatively course or rough in texture and application, such as stucco or grout used to lay rock or brick. Thus, a user may choose the type of finish-compound receiving member 200 to use depending upon the type of finish compound to be applied to a structural member.

It is further to be understood that the finish-compound receiving member 200 may be made from any suitable material capable of operating to provide the functions thereof. For example, the finish-compound receiving member 200 may comprise a steel plate, or it may be made from aluminum, any suitable metal, any suitable plastic, or any other material conducive to its purpose. One example of an optimal density for the finish-compound receiving member 200 would be a range of 0.07 pci to 0.19 pci ("pci" as used herein shall mean "pounds per cubic inch), and an even more optimal range of plate density for the finish-compound receiving member 200 would be 0.10 pci to 0.16 pci, and a further optimal density of said member 200 would be 0.13 pci. For example, one embodiment of a finish-compound receiving member 200 includes dimensions as follows: 13 inches in length, 5 inches in width, and 1/16 inch in thickness, having a weight of 8.6 ounces, which equates to a density of 0.13 pci.

In operation, the device or tool 10 of the present disclosure may be turned on/off using a toggle switch 340 that may be toggled back and forth to actuate the pump 350. As the pump 350 is actuated, finish compound may be pumped or dispensed from the reservoir 360 and into the conduit 300. Finish compound may travel from the conduit 300 through the at least one hole 114 of the handle base 110, or through hole 134 and into the hollow second support 130, and into the hollow interior 116 of the handle 100. Once in the hollow interior 116 of the handle 100, the finish compound may travel through the at least one opening 210 of the finish-compound receiving member 200 to the finish-compound receiving surface 202 for application to a structural member. When a user is finished with the finish compound or when the pump 350 is no longer necessary, the toggle switch 340 may be turned to an off position, thereby turning off the pump 350.

The device or tool 10 may also include a trigger 150 and a valve 160 as illustrated best in FIG. 8. The trigger 150 may be connected to the valve 160, which may be located inside of the hollow first support 120 or the hollow second support 130. When the trigger 150 is squeezed or depressed by a user the valve 160 may open allowing finish compound to freely flow from the conduit 300 through the hollow second support 130 and the hollow first support 120 to the hollow interior 116 of the handle 100. Once in the hollow interior 116, the finish compound may be applied as described herein.

It will be appreciated that any of the embodiments described herein may utilize the toggle switch 340. Further, the trigger 150 and the valve 160 may be used either in combination or individually with respect to the toggle switch 340 without departing from the scope of the present disclosure. Thus, in operation when a user turns the toggle switch 340 to the on position, the pump 350 is actuated and finish compound may be pumped from the reservoir 360 into the conduit 300, the through hole 134 and into the hollow second support 130 where the finish compound may be stopped temporarily by the valve 160. Once the trigger 150 is depressed or pulled, the valve 160 may open and finish compound is allowed to freely flow into the hollow interior 116 of the handle 100. Once in the hollow interior 116 of the handle 100, the finish compound may travel through the at least one opening 210 of the finish-compound receiving member 200 to the finish-compound receiving surface 202 for application to a structural member.

It will be appreciated that the various components of the device or tool may be modular with respect to each other to facilitate cleaning, repair or replacement. In other words, the various components of the handle 100 may be modular or may be monoblock. In either case, the handle 100 may be modular with respect to the finish-compound receiving member 200 and the conduit 300. Due to the modularity of the device or tool 10, the various components may be taken apart for cleaning and storage. Additionally, the device or tool 10 may be cleaned by simply pumping water through the conduit, the same as finish compound, until the tool 10 is washed clean. The modularity of the tool 10 of the present disclosure may also facilitate replacing worn or damaged parts without the expense of purchasing a new tool 10.

It will be appreciated that the structure and apparatus disclosed herein is merely one example of a means for supplying finish compound to the handle of the tool, and it should be appreciated that any structure, apparatus or system for supplying finish compound to the handle of the tool, which performs functions the same as, or equivalent to, those disclosed herein are intended to fall within the scope of a means for supplying finish compound to the handle of the tool, including those structures, apparatus or systems for supplying finish compound to the handle of the tool, which are presently known, or which may become available in the future. Anything that functions the same as, or equivalently to, a means for supplying finish compound to the handle of the tool falls within the scope of this element.

It will be appreciated that the structure and apparatus disclosed herein is merely one example of a means for handle base from the handle to the finish-compound receiving surface of the tool, and it should be appreciated that any structure, apparatus or system for handle base from the handle to the finish-compound receiving surface of the tool, which performs functions the same as, or equivalent to, those disclosed herein are intended to fall within the scope of a means for handle base from the handle to the finish-compound receiving surface of the tool, including those structures, apparatus or systems for handle base from the handle to the finish-compound receiving surface of the tool, which are presently known, or which may become available in the future. Anything that functions the same as, or equivalently to, a means for handle base from the handle to the finish-compound receiving surface of the tool falls within the scope of this element.

In accordance with the features and combinations described above, a useful method of supplying a tool with finish compound comprises the steps of:

(a) pumping finish compound from a reservoir through a conduit into at least one hole formed in a handle of the tool;

(b) receiving finish compound into a hollow interior of the handle through communication with the at least hole; and (c) dispensing finish compound from the hollow interior of the handle to a finish-compound receiving member having a finish-compound receiving surface of the tool through at least one opening formed through the finish-compound receiving member, such that finish compound flows from the hollow interior to the finish-compound receiving surface for applying finish compound to a structural member.

Those having ordinary skill in the relevant art will appreciate the advantages provide by the features of the present disclosure. For example, it is a potential feature of the present disclosure to provide an automatic, portable delivery device for supplying finish compound to a finish-compound receiving surface of a finish-compound receiving member for use in various construction projects. It is a further feature of the present disclosure to provide such a device that is inexpensive to make, simple in operation and that can be efficiently used by a construction worker. It is a further potential feature of the present disclosure, in accordance with one aspect thereof, to provide a tool comprising a conduit, a handle having a grip for a user to grasp the tool and a handle base having at least one hole formed therein to receive the conduit, and a finish-compound receiving member having at least one opening formed therein. It is yet another potential feature of the disclosure for the conduit to lead from a pump that contains a reservoir of finish compound to the at least one hole formed in the base of the handle. It is another potential feature of the disclosure for the base of the handle to include a hollow interior, such that finish compound is pumped through the conduit into the hollow interior, where the hollow interior communicates with the at least one opening formed in the finish-compound receiving member for dispensing finish compound to the finish-compound receiving surface for application.

In the foregoing Detailed Description of the Disclosure, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A tool for applying finish compound comprising:

a conduit that is attachable to a pump that is in communication with a reservoir of finish compound;

a handle having at least one hole formed therein for receiving the conduit, wherein the at least one hole leads to a hollow interior of said handle;

a finish-compound receiving member that is attachable to said handle comprising a finish-compound receiving surface (202) having at least one opening formed therethrough for dispensing finish compound from the hollow interior of said handle to the finish-compound receiving surface, wherein finish compound is pumped from the reservoir through said conduit into said hollow interior of said handle and through the at least one opening to said finish-compound receiving surface;

wherein the finish-compound receiving surface is a substantially flat trowel surface and wherein a length of the finish-compound receiving surface is at least two times a width of said finish-compound receiving surface.

2. The tool for applying finish compound of claim 1, wherein finish compound is accumulated in the hollow interior of the handle and is gradually dispensed through the at least one opening of the finish-compound receiving surface.

3. The tool for applying finish compound of claim 1, wherein the handle comprises an elongated base and wherein the elongated base comprises the at least one hole formed in said handle.

4. The tool for applying finish compound of claim 1, wherein the conduit further comprises an attachment piece, wherein the attachment piece is a hole coupler coupling the conduit to a hose of the pump.

5. The tool for applying finish compound of claim 1, wherein the handle comprises a base and a grip for a user to grasp the handle, wherein the grip is substantially parallel to the base and the finish-compound receiving surface.

6. The tool for applying finish compound of claim 1, wherein the finish-compound receiving member further comprises a substantially hollow body.

7. The tool for applying finish compound of claim 6, wherein the substantially hollow body of the finish-compound receiving member is disposed in fluidic communication with the hollow interior of the handle and is thereby made a part of a movement path of the finish compound as said finish compound is conveyed from the conduit through the handle and through the finish-compound receiving member and through the at least one opening in the finish-compound receiving surface.

8. The tool for applying finish compound of claim 1, wherein the handle further comprises a base, a first support extending from the base and a second support extending from the first support and terminating in a free end, wherein the at least one hole formed in the handle formed in the second support.

9. The tool for applying finish compound of claim 8, wherein the first support and second support are substantially hollow and the second support extends laterally from the first support.

10. The tool for applying finish compound of claim 1, wherein the handle further comprises a base having a side surface, wherein the at least one hole formed in the handle is formed in the side surface of said base.

11. The tool for applying finish compound of claim 1, wherein the finish-compound receiving member comprises a substantially hollow interior that communicates directly with the substantially hollow interior of the handle and is thereby made a part of a movement path of the finish compound as said first compound is conveyed from the conduit through the handle and through the finish-compound receiving member and through the at least one opening in the finish-compound receiving surface.

12. The tool for applying finish compound of claim 1, wherein the tool further comprises a toggle switch for actuating the pump.

13. The tool for applying finish compound of claim 1, wherein the handle comprises a trigger and a valve, such that when the trigger is actuated the valve opens thereby allowing finish compound to flow freely through said handle.

14. The tool for applying finish compound of claim 1, wherein the tool further comprises a toggle switch for actuating the pump;

wherein the handle comprises a trigger, a valve, at least one support and an opening formed in a free end of the support;

wherein the valve is located inside the at least one support of the handle and is actuated by the trigger, such that when the toggle switch is actuated, the pump dispenses finish compound from the reservoir to the conduit and into the support where the free flow of finish compound is controlled by the valve and the trigger.

15. The tool for applying finish compound of claim 1, wherein the finish-compound receiving member has a density within a range of 0.07 pci to 0.19 pci.

16. The tool for applying finish compound of claim 15, wherein the finish-compound receiving member has a density within a range of 0.10 pci to 0.16 pci.

17. The tool for applying finish compound of claim 15, wherein the finish-compound receiving member has a density of approximately 0.13 pci.

18. The tool for applying finish compound of claim 1, wherein the finish-compound receiving surface comprises a substantially flat surface.

19. The tool for applying finish compound of claim 18, wherein the substantially flat surface is a substantially flat towel surface.

20. The tool for applying finish compound of claim 18, wherein the handle further comprises a base formed as part of the handle and at least one hole formed in means for supplying finish compound to the handle comprising a pump and a flexible conduit attaching the pump to the at least one hole of the base.

21. The tool for applying finish compound of claim 20, wherein the handle further comprises a grip for a user to grasp said handle, wherein the grip is longitudinal and extends in a direction that is at least in part substantially parallel to the base and to the finish-compound receiving surface such that said grip is not extending perpendicular to said finish-compound receiving surface.

22. The tool for applying finish compound of claim 1, wherein the handle further comprises a base formed as part of the handle and at least one hole formed in the base; and means for supplying finish compound to the handle comprising a pump and a flexible conduit attaching the pump to the at least one hole of the base.

23. The tool for applying finish compound of claim 1, wherein the handle further comprises a grip for a user to grasp said handle and a base, wherein the grip is longitudinal and extends in a direction that is at least in part substantially parallel to the base and to the finish-compound receiving surface such that said grip is not extending perpendicular to said finish-compound receiving surface.

24. A tool for applying finish compound comprising:

a conduit that is attachable to a pump that is in communication with a reservoir of finish compound;

a handle having at least one hole formed therein for receiving the conduit, wherein the at least one hole leads to a hollow interior of said handle;

a finish-compound receiving member that is attachable to said handle comprising a finish-compound receiving surface (202) having at least one opening formed therethrough for dispensing finish compound from the hollow interior of said handle to the finish-compound receiving surface, wherein finish compound is pumped from the reservoir through said conduit into said hollow interior of said handle and through the at least one opening to said finish-compound receiving surface;

wherein the at least one hole formed in the handle comprises three holes and wherein a conduit is disposed in fluidic communication with each of said three holes.

25. The tool for applying finish compound of claim 24, wherein the conduit is flexible and further comprises a central hose that is attached to an attachment piece that is disposable into fluidic communication with the pump, and three discharge hoses that disseminate from and are disposed in fluidic communication with the central hose, each discharge hose being disposable into fluidic communication with one of the holes formed in the handle.

26. The tool for applying finish compound of claim 24, wherein the conduit is flexible and comprises three discharge hoses that are attached to an attachment piece.

27. A tool for applying finish compound comprising:

a conduit that is attachable to a pump that is in communication with a reservoir of finish compound;

a handle having at least one hole formed therein for receiving the conduit, wherein the at least one hole leads to a hollow interior of said handle;

a finish-compound receiving member that is attachable to said handle comprising a finish-compound receiving surface (202) having at least one opening formed therethrough for dispensing finish compound from the hollow interior of said handle to the finish-compound receiving surface, wherein finish compound is pumped from the reservoir through said conduit into said hollow interior of said handle and through the at least one opening to said finish-compound receiving surface;

wherein the at least one opening in the finish-compound receiving surface comprises a plurality of openings for dispensing finish compound from the hollow interior of the handle to the finish-compound receiving surface.

28. The tool for applying finish compound of claim 27, wherein the plurality of openings are substantially aligned in the linear manner.

29. The tool for applying finish compound of claim 28, wherein the plurality of openings are linearly aligned along a central, longitudinal axis.

30. The tool for applying finish compound of claim 29, wherein the plurality of openings are further aligned linearly along an axis perpendicular to the central, longitudinal axis.

31. The tool for applying finish compound of claim 27, wherein the plurality of openings are irregularly formed in the finish-compound receiving surface.

32. The tool for applying finish compound of claim 27, wherein the plurality of openings are formed in a pattern within the finish-compound receiving surface.

33. A tool for applying finish compound comprising:

a handle and a finish-compound receiving surface;

a means for supplying finish compound to the handle of the tool; and a means for conveying finish compound from the handle to the finish-compound receiving surface of the tool for application to a structural member;

wherein the means for handle base from the handle to the finish-compound receiving surface comprises a base formed as part of the handle and at least one hole formed in the base, wherein the means for supplying finish compound to the handle comprises a pump and a flexible conduit attaching the pump to the at least one hole of the base;

wherein the handle further comprises a grip from a user to grasp said handle, wherein the grip is substantially parallel to the base and to the finish-compound receiving surface, wherein the means for handle base from the handle base from the handle to the finish-compound receiving surface further comprises three holes formed in the base, and wherein the means for supplying finish-compound to the handle further comprises three hoses that disseminate from the conduit and attach to each of the three holes formed in the base.

34. The tool for applying finish compound of claim 33, wherein the means for handle base from the handle to the finish-compound receiving surface comprises a hollow interior formed within the handle.

35. The tool for applying finish compound of claim 34, wherein the means for handle base from the handle tot he finish-compound receiving surface further comprises at least one opening formed in the finish-compound receiving surface, wherein the hollow interior of the handle directly communicates with the at least one opening in the finish-compound receiving surface thereby dispensing finish compound.

36. The tool for applying finish compound of claim 35, wherein the at least one opening in the finish-compound receiving surface comprises a plurality of openings for dispensing finish compound from the hollow interior of the handle to the finish-compound receiving surface.

37. The tool for applying finish compound of claim 36, wherein the plurality of openings are substantially aligned in a linear manner.

38. The tool for applying finish compound of claim 37, wherein the plurality of openings are linearly aligned along a central, longitudinal axis.

39. The tool for applying finish compound of claim 38, wherein the plurality of openings are further aligned linearly along an axis perpendicular to the central, longitudinal axis.

40. The tool for applying finish compound of claim 36, wherein the plurality of openings are irregularly formed in the finish-compound receiving surface.

41. The tool for applying finish compound of claim 36, wherein the plurality of openings are formed in a pattern within the finish-compound receiving surface.

42. The tool for applying finish compound of claim 35, wherein the at least one opening in the finish-compound receiving surface in a single elongated slot for dispensing finish compound from the hollow interior of the handle to the finish-compound receiving surface.

43. The tool for applying finish compound of claim 33, wherein the means for handle base from the handle to the finish-compound receiving surface comprises a hollow interior formed within the handle.

44. The tool for applying finish compound of claim 43, wherein the means for handle base from the handle to the finish-compound receiving surface further comprises at least one opening formed in the finish-compound receiving surface, wherein the hollow interior of the handle directly communicates with the at least one opening in the finish-compound receiving surface thereby dispensing finish compound.

45. The tool for applying finish compound of claim 44, wherein the at least one opening in the finish-compound receiving surface comprises a plurality of openings for dispensing finish compound from the hollow interior of the handle to the finish-compound receiving surface.

46. The tool for applying finish compound of claim 45, wherein the plurality of openings are substantially aligned in a linear manner.

47. The tool for applying finish compound of claim 45, wherein the plurality of openings are irregularly formed in the finish-compound receiving surface.

48. The tool for applying finish compound of claim 45, wherein the plurality of openings are formed in a pattern within the finish-compound receiving surface.

49. The tool for applying finish compound of claim 44, wherein the at least one opening in the finish-compound receiving surface is a single elongated slot for dispensing finish compound from the hollow interior of the handle to the finish-compound receiving surface.

50. A tool for applying finish compound comprising:

a handle and a finish-compound receiving surface;

a means for supplying finish compound to the handle of the tool; and a means for conveying finish compound from the handle to the finish-compound receiving surface of the tool for application to a structural member;

wherein the means for handle base from the handle to the finish-compound receiving surface comprises a base formed as part of the handle and three holes formed in the base, wherein the means for supplying finish compound to the handle comprises a pump and a flexible conduit having three hoses attachable to the pump and to the three holes of the base.

51. The tool for applying finish compound of claim 50, wherein the means for handle base from the handle to the finish-compound receiving surface comprises a hollow interior formed within the base of the handle.

52. The tool for applying finish compound of claim 51, wherein the means for handle base from the handle to the finish-compound receiving surface further comprises at least one opening formed in the finish-compound receiving surface, wherein the hollow interior of the base of the handle directly communicates with the at least one opening in the finish-compound receiving surface thereby dispensing finish compound.

53. A tool for applying finish compound comprising:

a plurality of ducts forming a conduit that is attachable to or disposed into fluidic communication with a pump and a reservoir of finish compound;

a handle comprising a base having a plurality of holes formed therein that communicate with a hollow interior of the handle;

a finish-compound receiving member that is attachable to said handle comprises a finish-compound receiving surface with at least one opening formed therethrough for dispensing finish compound from the hollow interior of said handle to the finish-compound receiving surface for application to the structural member;

wherein the finish-compound receiving surface is a substantially flat trowel surface where a length of the finish-compound receiving surface is at least two times a width of said finish-compound receiving surface.

54. The tool for applying finish compound of claim 53, wherein finish compound is pumped from the reservoir through said plurality of ducts into said hollow interior of said handle and through the at least one opening to said finish-compound receiving surface.

55. The tool for applying finish compound of claim 53, wherein finish compound is accumulated in the hollow interior of the handle and is gradually dispensed through the at least one opening of the finish-compound receiving surface.

56. The tool for applying finish compound of claim 53, wherein the base of the handle is elongated and the handle further comprises a grip for a user to grasp the handle, wherein the grip is substantially parallel to the base and the finish-compound receiving surface.

57. The tool for applying finish compound of claim 53, wherein the at least one opening in the finish-compound receiving surface comprises a plurality of openings for dispensing finish compound from the hollow interior of the handle to the finish-compound receiving surface.

58. The tool for applying finish compound of claim 57, wherein the plurality of openings are substantially aligned in a linear manner.

59. The tool for applying finish compound of claim 58, wherein the plurality of openings are linearly aligned along a central, longitudinal axis.

60. The tool for applying finish compound of claim 59, wherein the plurality of openings are further aligned linearly along an axis perpendicular to the central, longitudinal axis.

61. The tool for applying finish compound of claim 57, wherein the plurality of openings are irregularly formed in the finish-compound receiving surface.

62. The tool for applying finish compound of claim 57, wherein the plurality of openings are formed in a pattern within the finish-compound receiving surface.

63. The tool for applying finish compound of claim 53, wherein the a least one opening in the finish-compound receiving surface is a single elongated slot for dispensing finish compound from the hollow interior of the handle to the finish-compound receiving surface.

64. A tool for applying finish compound cornprising;

a plurality of ducts forming a conduit that is attachable to or disposable into fluidic communication with a pump and a reservoir of finish compound;

a handle comprising a base having a plurality of holes formed therein that communicate with a hollow interior of the handle;

a finish-compound receiving member that is attachable to said handle comprising a finish-compound receiving surface with at least one opening formed therethrough for dispensing finish compound from the hollow interior of said handle to the finish-compound receiving surface for application to a structural member;

wherein the plurality of holes formed in the handle comprises three holes;

wherein the plurality of ducts forming the conduit comprises three flexible discharge hoses that are each attachable to one of the three holes formed in the handle.

65. A tool for applying finish compound comprising:

a flexible conduit that is attachable to a pump that is in communication with a reservoir of finish compound;

a handle comprising a base having at least one hole formed therein, wherein the conduit is attachable to the at least one hole of the base thereby supplying finish compound from the conduit to the handle: and a finish-compound receiving member that is attachable to the handle comprising a finish-compound receiving surface having at least one opening formed therethrough for dispensing finish compound from the handle to the finish-compound receiving surface;

wherein the handle further comprises a first support extending from the base and a second support extending laterally from the first support and terminating in a free end.

66. The tool for applying finish compound of claim 65, wherein the at least one hole leads to a hollow interior of said handle and wherein the second support of the handle is substantially parallel to the base and the finish-compound receiving surface.

67. The tool for applying finish compound of claim 55, wherein finish compound is pumped from the reservoir through said conduit into said hollow interior of said handle and through the at least one opening to said finish-compound receiving surface.

68. A tool for applying finish compound, said tool comprising:

a finish-compound receiving member comprising a finish-compound receiving surface for applying finish compound to a structural member, and an upper surface on a side of said finish-compound receiving member that is opposite said finish-compound receiving surface:

a receptacle for receiving finish compound, said receptacle contacting said upper surface of said finish-compound receiving member; and a conduit for supplying finish compound to said receptacle;

wherein finish compound is pumped through said conduit to said receptacle and to said finish-compound receiving surface for applying the finish compound to the structural member.

69. The tool for applying finish compound of claim 68 wherein the receptacle comprises an area that is about three percent to about ninety-five percent of an area of the upper surface of the finish-compound receiving member.

70. The tool for applying finish compound of claim 69, wherein the area of the receptacle is about ten percent to about thirty-five percent of the area of the finish-compound receiving member.

71. A method of supplying a tool with finish compound comprising the steps of:

(a) pumping finish compound from a reservoir through a conduit into at least one hole formed in a handle of the tool;

(b) receiving finish compound into a hollow interior of the handle through communication with the at least hole of the handle; and (c) dispensing finish compound from the hollow interior of the handle to a finish-compound receiving surface of the tool through at least one opening formed through the finish-compound receiving surface, such that finish compound flows from the hollow interior to said finish-compound receiving surface for applying finish compound to a structural member;

wherein the conduit of step (a) is flexible and comprises a plurality of discharge hoses that are attached to a plurality of holes formed in the handle.

72. The method of claim 71, wherein the handle comprises a base comprising the at least one hole and a grip for a user to grasp said handle, wherein the grip is substantially parallel to the base and to the finish-compound receiving surface.

73. The method of claim 71, wherein the conduit of step (a) is flexible and comprises a single discharge hose that is attached to a single hole formed in the handle.

74. The method of claim 71, wherein the finish-compound receiving surface comprises a plurality of openings communicating with the hollow interior of the handle, such that finish compound flows from the hollow interior of the handle through the plurality of openings to the finish-compound receiving surface.

75. The method of claim 74, wherein the plurality of openings are formed in a pattern.

76. The method of claim 74, wherein the plurality of openings are formed in a linear manner.

77. The method of claim 76, wherein the openings are linearly aligned along a central, longitudinal axis.

78. The method of claim 77, wherein the openings are further aligned linearly along an axis perpendicular to the central, longitudinal axis.

79. The method of claim 74, wherein the plurality of openings are formed irregularly.

80. The method of claim 71, wherein the at least one opening is a slot formed in the finish-compound receiving surface for communicating with the hollow interior of the handle, such that finish compound flows from the hollow interior of the handle through the slot to the finish-compound receiving surface.

81. A tool for applying finish compound comprising:

a flexible conduit comprising an attachment piece that is attachable to a pump in communication with a reservoir of finish compound;

a handle having at least one hole formed therein for receiving the conduit, wherein the at least one hole leads to a hollow interior of said handle;

a finish-compound receiving member that is attachable to said handle comprising a finish-compound receiving surface having at least one opening formed therethrough for dispensing finish compound from the hollow interior of said handle to the finish-compound receiving surface, wherein finish compound is pumped from the reservoir through said conduit into said hollow interior of said handle and through the at least one opening to said finish-compound receiving surface;

wherein the finish-compound receiving surface is a substantially flat trowel surface where a length of the finish-compound receiving surface is at least two times a width of said finish-compound receiving surface;

wherein the conduit comprises a central hose that is attached to the attachment piece and three discharge hoses that disseminate from the central hose and that are attachable to the at least one hole formed in the handle;

wherein finish compound is accumulated in the hollow interior of the handle and is gradually dispensed through the at least one opening of the finish-compound receiving surface:

wherein the handle comprises an elongated base and wherein the elongated base comprises the at least one hole formed in said handle;

wherein the handle comprises a base and a grip for a user to grasp the handle, wherein the grip is substantially parallel to the base and the finish-compound receiving surface; and wherein the attachment piece is a hose coupler coupling the conduit to a hose of the pump.

82. The tool for applying finish compound of claim 81, wherein the at least one opening in the finish-compound receiving surface comprises a plurality of openings for dispensing finish compound from the hollow interior of the handle to the finish-compound receiving surface.

83. The tool for applying finish compound of claim 82, wherein the plurality of openings are substantially aligned in a linear manner.

84. The tool for applying finish compound of claim 83, wherein the plurality of openings are linearly aligned along a central longitudinal axis.

85. The tool for applying finish compound of claim 84, wherein the plurality of openings are further aligned linearly along an axis perpendicular to the central, longitudinal axis.

86. The tool for applying finish compound of claim 82, wherein the plurality of openings are irregularly formed in the finish-compound receiving surface.

87. The tool for applying finish compound of claim 82, wherein the plurality of openings are formed in a pattern within the finish-compound receiving surface.

88. The tool for applying finish compound of claim 81, wherein the at least one opening is a slot formed in the finish-compound receiving surface for communicating with the hollow interior of the handle; such that finish compound flows from the hollow interior of the handle through the slot to the finish-compound receiving surface.

89. The tool for applying finish compound of claim 81, wherein the finish-compound receiving member has a density within a range of 0.07 pci to 0.19 pci.

90. The tool for applying finish compound of claim 89, wherein the finish-compound receiving member has a density within a range 0.10 pci to 0.16 pci.

91. The tool for applying finish compound of claim 89, wherein the finish-compound receiving member has a density of approximately 0.13 pci.

92. A tool for applying finish compound comprising:

a conduit that is attachable to a pump that is in communication with a reservoir of finish compound;

a handle having at least one hole formed therein for receiving the conduit, wherein the at least one hole leads to a hollow interior of said handle:

a finish-compound receiving member that is attachable to said handle comprising a finish-compound receiving surface (202) having at least one opening formed therethrough for dispensing finish compound from the hollow interior of said handle to the finish-compound receiving surface, wherein finish compound is pumped from the reservoir through said conduit into said hollow interior of said handle and through the at least one opening to said finish-compound receiving surface:

wherein the finish-compound receiving member comprises a plurality of finish-compound receiving members that are interchangeable, with each other.

93. The tool for applying finish compound of claim 92, wherein the at least one opening in the finish compound receiving surface comprises a plurality of openings for dispensing finish compound from the hollow interior of the handle to the finish-compound receiving surface.

94. The tool for applying finish compound of claim 93, wherein the plurality of openings in each of the plurality of finish-compound receiving members are sized differently to allow different finish compounds to be easily applied to a structural member.

* * * * *